United States Patent [19]

Tillman

[11] Patent Number: 4,890,588

[45] Date of Patent: Jan. 2, 1990

[54] MEANS TO CONTROL PISTON MOVEMENT IN RELATIONSHIP TO CRANK ARM ROTATION IN AN INTERNAL COMBUSTION ENGINE

[76] Inventor: John E. Tillman, 1207 Dakota N.E., Albuquerque, N. Mex. 87110

[21] Appl. No.: 150,386

[22] Filed: Jan. 29, 1988

[51] Int. Cl.[4] ..... F02B 75/04

[52] U.S. Cl. ..... 123/78 E; 123/78 B; 123/197 AB

[58] Field of Search ..... 123/48 R, 48 B, 78 R, 123/78 B, 78 E, 78 F, 197 R, 197 A, 197 AB, 197 AC

[56] References Cited

U.S. PATENT DOCUMENTS

| | | | |
|---|---|---|---|
| 669,416 | 3/1901 | Johnson | 123/78 B |
| 1,317,788 | 10/1919 | Hinsdale | 123/78 E |
| 1,379,115 | 5/1921 | Mallory | 123/197 A |
| 1,741,766 | 12/1929 | Gockerell | 123/78 B |
| 2,458,111 | 1/1949 | Soltesz | 123/78 B |

FOREIGN PATENT DOCUMENTS

| | | | |
|---|---|---|---|
| 321044 | 5/1902 | France | 123/78 E |

*Primary Examiner*—Craig R. Feinberg

*Attorney, Agent, or Firm*—Robert W. Weig; Deborah A. Peacock

[57] ABSTRACT

A means to control piston movement in relationship to crank arm rotation in an internal combustion engine is provided. There is provided a system to permit the crank arm of an engine to rotate a number of degrees past what would be the normal TDC (TOP DEAD CENTER). There is also provided a means to lift the piston to its highest point when the crank arm has reached its predetermined number of degrees past normal TDC. A mechanical linkage has been provided to replace the usual connecting rod. A short link is assembled to the crank arm bearing by means of a journal. The crank arm length is coupled to a longer link through a coupling pin. The longer link is attached to the piston by a standard piston pin.

9 Claims, 3 Drawing Sheets

MEANS TO CONTROL PISTON MOVEMENT IN RELATIONSHIP TO CRANK ARM ROTATION IN AN INTERNAL COMBUSTION ENGINE

BACKGROUND OF THE INVENTION

The present invention generally appertains to improvements in internal combustion engines, and more particularly to a means of controlling piston movement in relationship to crank arm rotation in an internal combustion engine.

DESCRIPTION OF THE PRIOR ART

Various kinds of engine rods and piston assemblies or systems are well known, as for example, as shown in prior U.S. Pat. Nos.: 1,622,919; 1,979,987; 2,164,612; 2,165,791; 2,287,472; 2,390,558; 3,034,362; 3,087,342; 3,129,892; 3,626,786; 3,693,463; 3,859,976; 3,908,623; 4,073,196; 4,085,628; 4,089,235; 4,319,498; 4,463,710; 4,467,756; as well as French Patent No. 2,414,122 and French Patent No. 555,308. However, neither these prior patents nor any others known to Applicant achieve the results accomplished by the present invention.

OBJECTS AND SUMMARY OF THE PRESENT INVENTION

A primary object of the present invention is to provide a means for controlling piston movement in relationship to crank arm rotation in an internal combustion engine.

Another object of the present invention is to provide a system that will permit the crank arm of an engine to rotate a number of degrees past would would be the normal TDC (TOP DEAD CENTER), while providing a means for lifting the piston to its highest point when the crank arm has reached the predetermined number of degrees past normal TDC.

A still further object of the present invention is to provide a means to control piston movement in relationship to crank arm rotation in an internal combustion engine, wherein a mechanical linkage has been devised or provided to replace the usual connecting rod. A short link (called crank arm link) is assembled to the crank arm bearing by means of a journal. The crank arm link is coupled to a longer link called (con rod link) through a coupling pin and the con rod link is attached to the piston by a standard piston pin.

A still further object of the present invention is to provide a means for controlling piston movement in a relationship to crank arm rotation in an internal combustion engine, that can be inexpensively manufactured and which will accomplish the desired purposes with maximum efficiency.

These and other objects of the present invention will become apparent with reference to the drawings, the description of the preferred embodiments, and appended claims.

DESCRIPTION OF THE PREFERRED EMBODIMENTS

Figure 1:
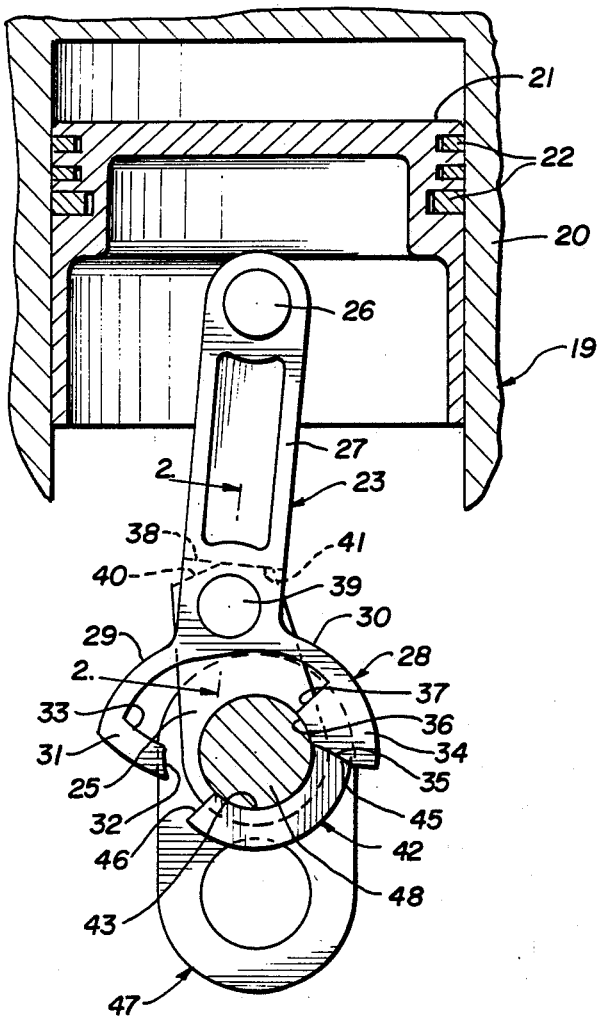
FIG. 1 is a fragmentary sectional view illustrating the means for controlling piston movement in relationship to crank arm rotation in an internal combustion engine, constructed in accordance with the present invention.
Figure 2:
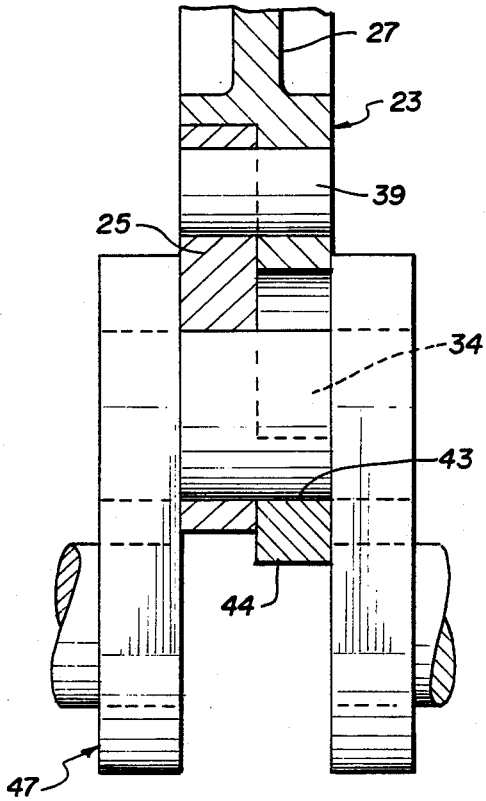
FIG. 2 is an enlarged sectional view taken on line 2—2 of FIG. 1.
Figure 9:
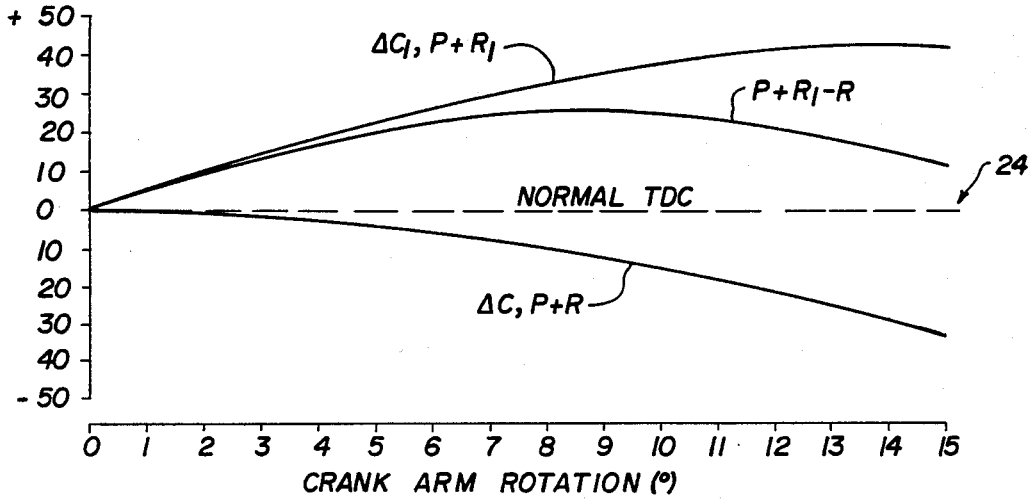
FIG. 9 is a diagramatic view illustrating certain features of the present invention.

Referring in detail to the drawings, the numeral 20 indicates a conventional cylinder for an internal combustion engine 19, and the cylinder 20 has the usual piston 21 reciprocally mounted herein. The piston 21 may have the usual rings 22 thereon, FIG. 1.

In accordance with the present invention there is provided a means for controlling piston movement in relationship to crank arm rotation in an internal combustion engine. This means includes a two piece con rod that includes a con rod link 23 and a crank arm link 25. The numeral 25 indicates the crank arm link. The con rod link 23 includes an elongated portion 27 that is connected to the piston 21 by means of a pivot pin 26, and formed integrally with the con rod 23 is a fork or yoke 28, and the yoke 28 includes portions 29 and 30. Extending inwardly from the portion 29 of the yoke 28 is a projection 31 that has an end surface 32 and an inner edge or surface 33.

Formed integrally with the portion 30 of the yoke 28 is a shoulder 34 that has surfaces or edges 35, 36, and 37. The con rod link 23 has a surface or shoulder 38 for a purpose to be later described.

As shown in the drawings the crank arm link 25 is swivelly or pivotally connected to the con rod link 23 by a pin 39, and one end of the crank arm link 25 has inclined or angularly arranged surfaces 40 and 41 for selectively engaging the mating surface 38. A cam 42 is provided, and the cam 42 is an integral part of the crank arm 47. The cam 42 includes inner and outer curved surfaces 43 and 44 as well as end portions 45 and 46. The numeral 47 indicates a portion of the usual crank arm of the internal combustion engine. The numeral 48 indicates the journal center.

In the present invention there is provided a system that will permit the crank arm of an engine to rotate a number of degrees past what would be the normal TDC, while providing a means to lift the piston to its highest point when the crank arm has reached its predetermined number of degrees past normal TDD.

In standard practice, the normal design of combustion engines consist of a crank shaft incorporating crank arms which, through connecting rods control piston movement. The top positions of the crank arm and piston movement are called TDC, (TOP DEAD CENTER) and determine maximum compression of the fuel mixture. It is standard practice to initiate ignition of the fuel mixtures by diesel injection or electrical spark, at sometime prior to TDC to promote combustion in the maximum combustion area.

It is readily appreciated that if at the time of ignition the crank arm has several degrees of rotation before TDC that any thrust developed would be in opposition to crank rotation, at TDC the crank arm is in a position of zero thrust, the angle of thrust changes slowly from zero at TDC through several degrees of crank rotation.

In accordance with the present invention a mechanical linkage has been devised to replace the usual connecting rod. A short link 25 called crank arm link, is assembled to the crank arm bearing by means of a journal. The crank arm link 25 is coupled to a longer link 23 called con rod link, through a coupling pin 39. The con rod link 23 is attached to the piston 21 by a standard piston pin 26.

With further reference to the drawings, it is seen that the crank arm link 25 has been set at an angle to the con rod link 23. When the crank arm has rotated past normal TDC (15° for example), the link pin 24 connecting the crank arm link 25 to the con rod link 23 lies on a straight line from the crank arm bearing center to the piston pin center. When the crank arm rotates past normal TDC the movement of the con rod link 23 is restrained and an effective top position (TPP) is produced. When plotted through a crank arm rotation of 15° TPP would occur approximately 9° past normal TDC as shown by the numeral 24.

Some of the advantages of TPP over TDC are as follows. When the time of ignition is set at the same relative position to TPP as it would be at TDC it is seen that the angle of thrust from the piston 21 through the linkage is greatly enhanced. For comparison, a linkage equal in length to a con rod and equivalent length of stroke was selected. The angle of thrust (10°) rotation past TPP is approximately 27°. The advantage of more than two to one can be clearly shown graphically.

In operation, referring to FIGS. 3, 4, 5, 6, 7, and 8 of the drawings, the crank arm link 25 is assembled to the con rod link 23 by a link pin 39. A mating surface 38 is provided on the con rod link 23 to limit the rotation of the crank arm link 25 around the link pin 39. The crank arm link mating surfaces 41 and 40 establish the angle of the crank arm link 25 to the con rod link 23 during the following cycles of operation.

Figure 3:
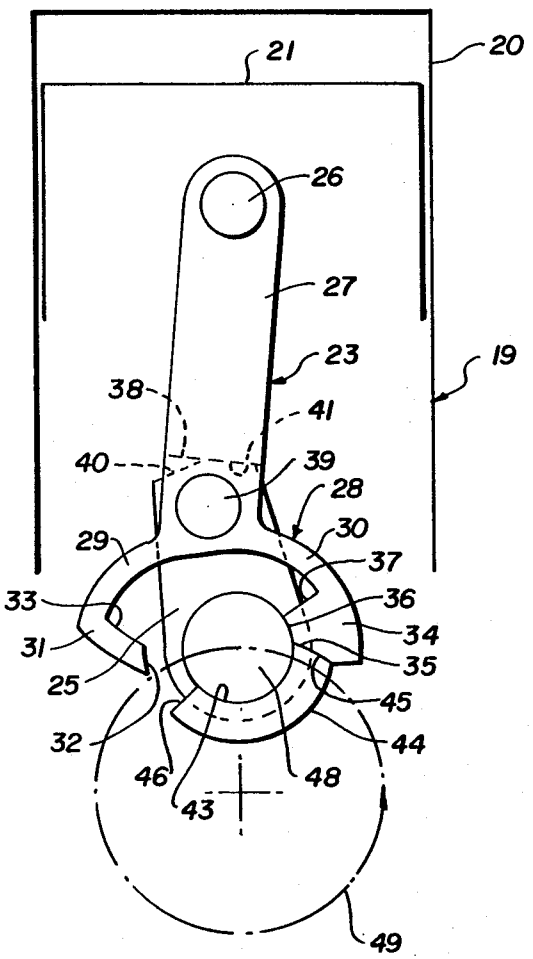
Figure 8:
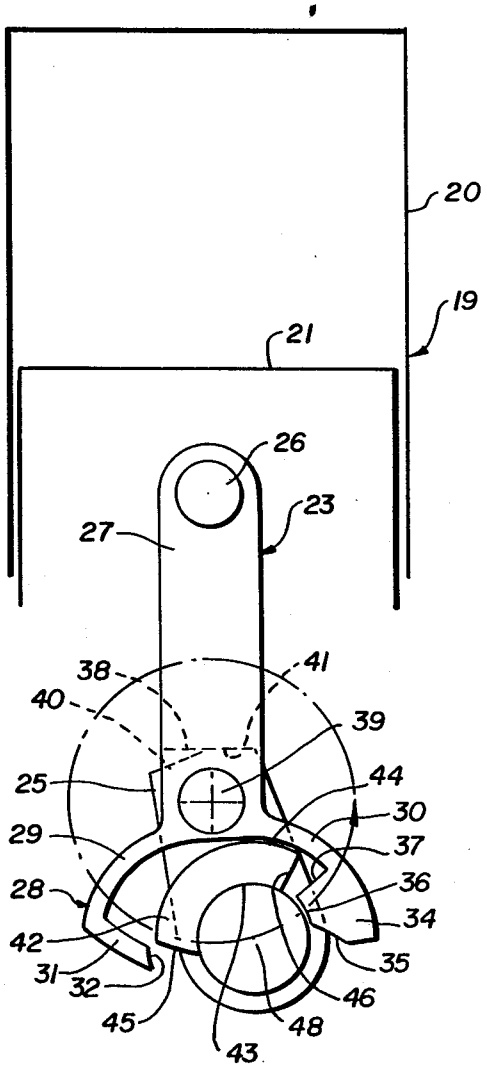
Figure 7:
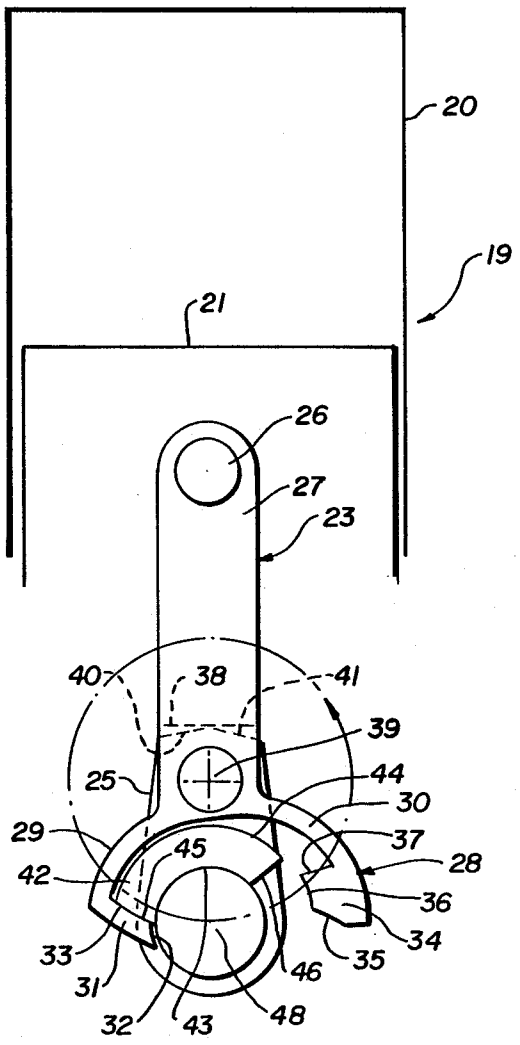

From FIG. 8 to FIG. 3 the thrust provided by crank arm motion during exhaust and compression cycles to return piston to its top position holds the crank arm link 25 at an angle to the con rod link 23 as limited by the mating surface 41 of the crank arm link and the surface 38 of the con rod link.

Figure 4:
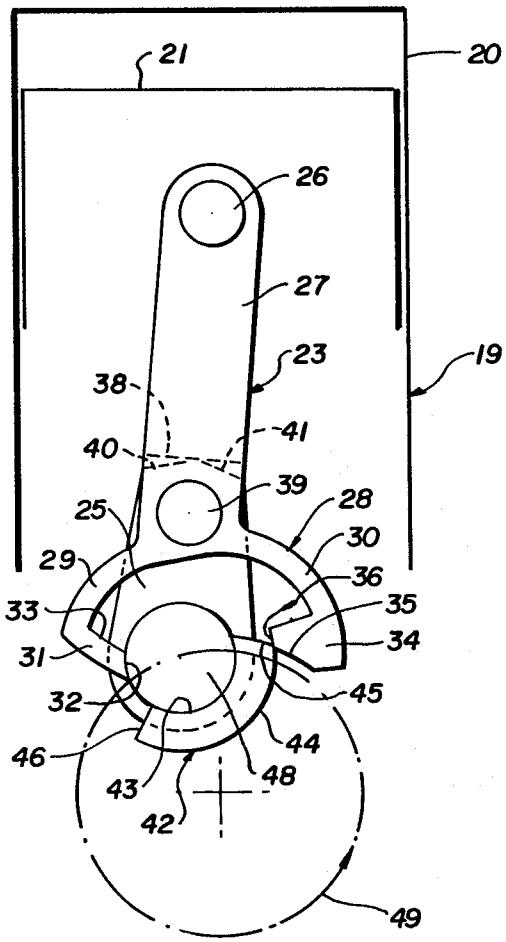

From FIG. 3 to FIG. 4 the cam control surface 45 mates with the yoke control surface 35. Both surfaces are developed as radii of the center of the crank arm bearing circle of revolution, when at the position shown in FIG. 3. The cam control surface 45 then holds the yoke 28 of the con rod link 23 in one relative position while the crank arm bearing center 48 reaches the position shown in FIG. 4, where the crank arm bearing center 48, the link pin center 39, and the piston pin center 26 are in alignment.

Figure 5:
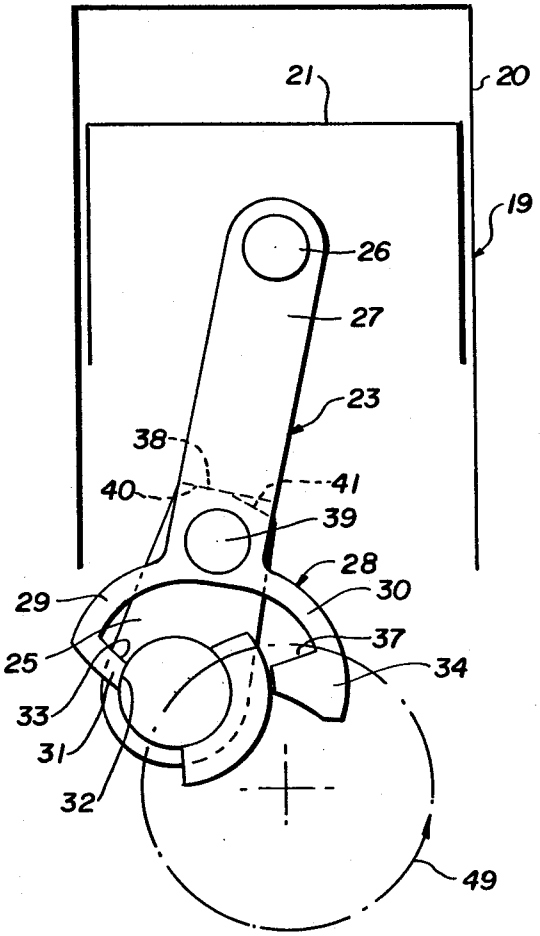
FIGS. 3 through 8 are schematic views illustrating the means to control piston movement in relationship to crank arm rotation in internal combustion engines.

From FIG. 4 to FIG. 5 the cam control surface 45 still holds the yoke 28 of the con rod link 23 in one position while the crank arm bearing 48 rotates the crank arm link 25 a short way past alignment to develop an offset to the con rod link 23 as limited by the mating surface 40 of the crank arm link 25 to the con rod link surface 38.

Figure 6:
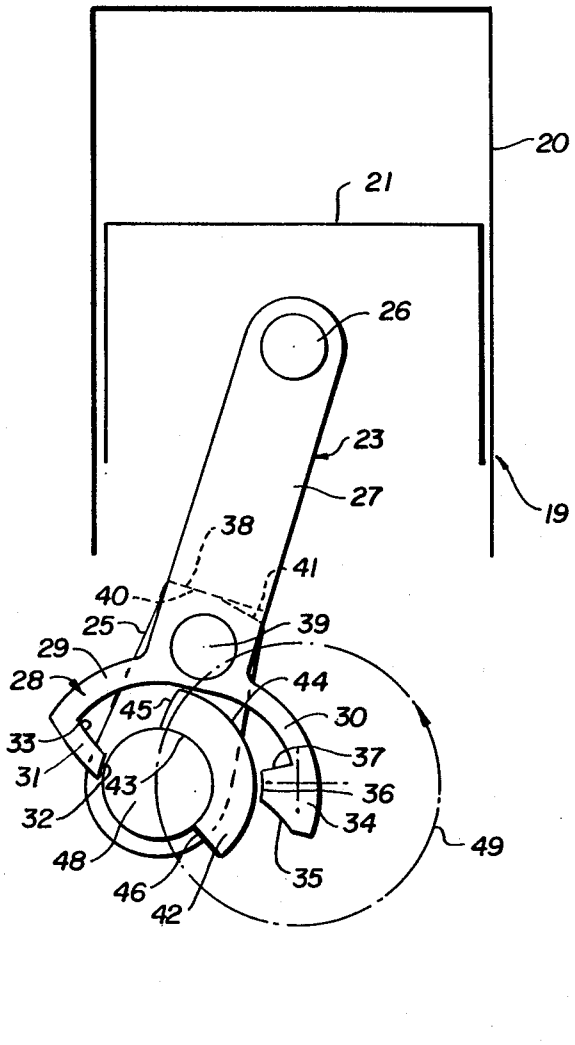

From FIG. 5 to FIG. 6 the cam dwell surface 44 mating with the dwell surface 36 of the con rod yoke 28 maintains this offset throughout the power stroke and the intake stroke of the engine. Attention is directed to the movement from FIG. 7 to FIG. 8. At the end of the dwell, at the bottom of the power and intake stroke, the cam control surface 45 engages the opposite side 33 of the yoke and holds the con rod link 23 in one position while the crank arm bearing center 48 moves the crank arm link 25 to the position shown in FIG. 8 where the developed angle of the crank arm link 25 is limited by the mating surfaces 41 and 38 of the crank arm link and the con rod link.

It will therefore be seen that in accordance with the present invention that there has been provided a device that controls piston movement in relationship to position of crank shaft rotation. There is a two piece con rod that consists of a crank arm link 25 and a con rod link 23. There is provided a mechanism that permits a two piece con rod to change overall effective length of the con rod as a function of crank shaft rotation. There is also provided a means to determine con rod link relationship to crank arm rotation through a yoke 28 that is an integral part of the con rod link 23, controlled by a cam 42 incorporated as part of the crank shaft arm. With the present invention, there is used the means normally provided in any engine to select the point that suits the particular application.

The cam surface 44 maintains the offset of the crank link in respect to the con rod link through control of the yoke position during the stroke.

Also, it is possible to set the angle of the crank arm link 15 degrees to the left of the center line rather than to the right of the center line. If the cam is set 180 degrees from that illustrated in the drawing and changing the mating surfaces of the crank link to con rod link, one can develop an identical action.

With further reference to the advantage of TPP over TDC, when the time of ignition is set at the same relative position to TPP as it would be at TDC, it is seen that the angle of thrust from the piston through the linkage is greatly enhanced.

For comparison a linkage equal in length to a con rod and equivalent length of stroke was selected. The angle of thrust (10°) rotation past TPP is approximately 27°. The advantage of 2 to 1 can be clearly shown graphically and is governed by the formula that the sine of the angle times the applied force is equal to the thrust developed.

The bearing surfaces of the cam and fork are both formed as radii of the crank arm center. The cam rotates under the fork and holds it in one position while the crank arm rotates. In FIGS. 3 to 8 the numeral 49 indicates the rotation of the crank arm. The cam is part of the crank arm.

The parts can be made of any suitable material and in different shapes and sizes as desired or required.

While several embodiments of the present invention have been illustrated herein in particular detail, it will be understood that variations and modifications may be effected without departing from the spirit and scope of the novel concepts of this invention.

I claim:

1. In an internal combustion engine having a crank arm and a piston within a cylinder, a two-piece connecting arm linkage apparatus for controlling piston movement in relation to crank arm rotation comprising:

a con rod link and a crank arm link, said con rod link being substantially longer than said crank arm link;

said con rod link being integrally formed with two ends, one end which is rotatably affixable to the piston with pivot pin means, the other end comprising a yolk having a base and two arms extending downward therefrom and means for linking said yoke base of said con rod link to said crank arm link using link pin means;

said crank arm link comprising means disposed at one end thereof for linking said crank arm link to said yoke base of said con rod link using said link pin means and means disposed at the other end thereof for rotatably affixing said crank arm link to the crank arm;

cam means affixed on said crank arm for selectively engaging surfaces on said yoke of said con rod link; and means for controlling the amount of rotation of said crank arm link about said link pin means, whereby said rotation controlling means and said yoke engaging cam means, during operation, act cooperatively to provide an effective top position for the piston within the cylinder after the crank arm affixing means has moved a predetermined amount past a top dead center position, thereby providing for fuel ignition to occur after the crank arm has passed its point of top dead center.

2. The invention of claim 1 wherein said rotation controlling means of said yoke engaging cam means provide an effective top position for the piston at least about 9 degrees past the top dead center of the crank arm.

3. The invention of claim 1 wherein said cam means comprises an arcuate cam element disposed to engage inside surfaces on said arms of said yoke during operation.

4. The invention of claim 1 wherein said rotation controlling means comprise mating surfaces on said con rod link and said crank arm link.

5. The invention of claim 4 wherein said mating surfaces comprise one flat mating surface cooperating with a pair of angularly arranged mating surface.

6. The invention of claim 5 wherein said one flat mating surface is positioned on said con rod link and said angularly arranged mating surface is disposed on said crank arm link.

7. The invention of claim 6 wherein said cam means comprises an essentially arcuate circumferential yoke engaging surface adjoining a pair of generally radial yoke engaging surfaces and said arms of said yoke comprising a substantially flattened arcuate surface for mating with said arcuate cam surface and surfaces disposed at distal ends of said yoke arms for engaging said generally radial cam surfaces.

8. The invention of claim 7 wherein one of said yoke arms comprises a projection having an inner surface for engaging one of said radial surfaces of said cam means and an end surface for engaging said arcuate surface of said cam means.

9. The invention of claim 8 wherein the other of said yoke arms comprises a shoulder portion having an end surface for engaging the other radial surface of said cam means and an arcuate surface for engaging said radial surface of said cam means.

* * * * *